US005117596A

United States Patent [19]

Leslie et al.

[11] Patent Number: 5,117,596

[45] Date of Patent: Jun. 2, 1992

[54] PORTABLE DANCE FLOOR

[75] Inventors: Robert H. Leslie, Edina; Michael D. Jines, Owatonna, both of Minn.

[73] Assignee: Wenger Corporation, Owatonna, Minn.

[21] Appl. No.: 461,488

[22] Filed: Jan. 5, 1990

[51] Int. Cl.[5] ..... E04B 5/02

[52] U.S. Cl. ..... 52/126.6; 52/79.4; 52/227; 52/236.1; 52/586

[58] Field of Search ..... 52/126.6, 126.5, 79.4, 52/236.1, 236.2, 586, 125.5

[56] References Cited

U.S. PATENT DOCUMENTS

| | | | |
|---|---|---|---|
| 3,372,518 | 3/1968 | Rensch | 52/227 |
| 3,470,663 | 10/1969 | Tate | 52/126.6 |
| 3,641,730 | 2/1972 | Meckstroth | 52/586 |
| 3,680,277 | 8/1972 | Martin | 52/586 |

FOREIGN PATENT DOCUMENTS

| | | | |
|---|---|---|---|
| 1291709 | 10/1972 | United Kingdom | 52/126.5 |

*Primary Examiner*—David A. Scherbel
*Assistant Examiner*—Kien Nguyen
*Attorney, Agent, or Firm*—Dorsey & Whitney

[57] ABSTRACT

A portable dance floor includes a plurality of pie-shaped platform segments having matingly engageable peripheral edges. The platform segments are made from a study, lighweight honeycomb construction. A unique connecting hub couples the apexes of a plurality of platform segments together, and an adjustable web extends around the outer periphery of the combined platform segments. A key way and supporting key are provided along the adjoining edges of adjacent platform segments. Each of the segments may be supported by one or more adjustable support legs.

2 Claims, 5 Drawing Sheets

PORTABLE DANCE FLOOR

TECHNICAL FIELD

This invention relates to raised flooring structures. In particular, it relates to a portable raised flooring structure that is particularly adapted for use as a dance floor.

BACKGROUND ART

Dance floors, particularly dance floors used for competitive or professional dancing, should be level and have a smooth, continuous surface. Accordingly, in performance areas with an uneven or unlevel floor space, it is desirable to set up a portable dance floor to accommodate scheduled dance events. The ideal portable dance floor would be lightweight yet sturdy, and be capable of being put together in various configurations so as to be adaptable to different performance areas. Moreover, a preferred portable dance floor should include the ability to provide a level dancing platform in performance areas that have an uneven floor space.

SUMMARY OF THE INVENTION

The characteristics of a preferred portable dance floor, as outlined above, are met by the portable dance floor in accordance with the present invention. The dance floor hereof includes a plurality of pie-shaped platform segments that include matingly engageable marginal edges. The platform segments are preferably made of a sturdy, yet lightweight honeycomb construction. A unique connecting hub provides a means for coupling several of the platform segments together at their apexes, and an adjustable web is provided to extend around the outer periphery of the combined platform segments, thereby holding the segments together. A key way and supporting key are provided along the adjoining peripheral edges of adjacent platform segments. Each of the segments may be supported by one or more adjustable support legs.

DETAILED DESCRIPTION OF THE DRAWINGS

Figure 1:
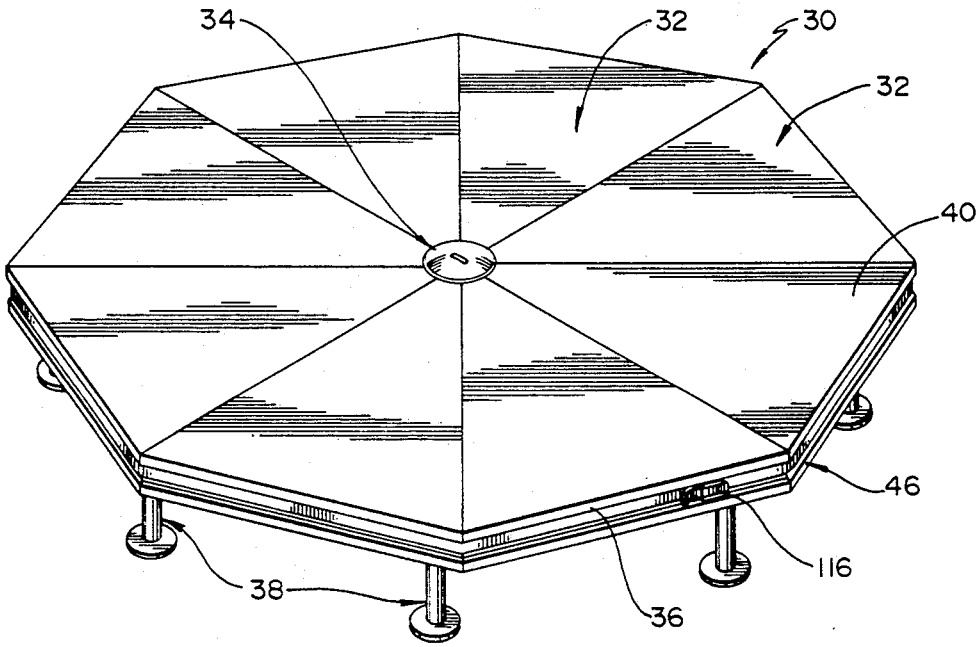
FIG. 1 is a perspective view of a portable dance floor in accordance with the present invention.

Referring to the drawings, the portable dance floor 30 in accordance with the present invention broadly includes a plurality of platform segments 32, a connecting hub 34, a securing belt 36, and a plurality of adjustable support legs 38.

Figure 2:
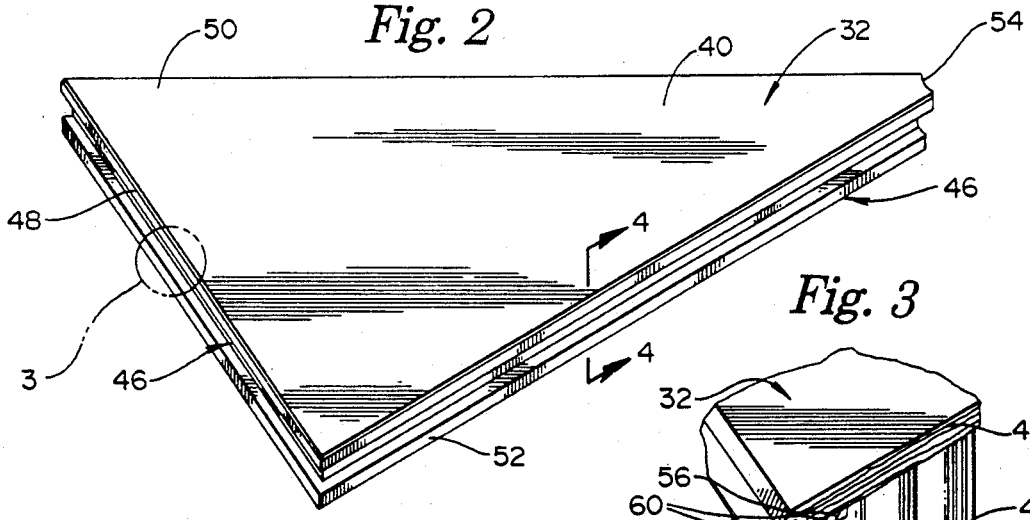
FIG. 2 is a perspective view of a platform segment.
Figure 3:
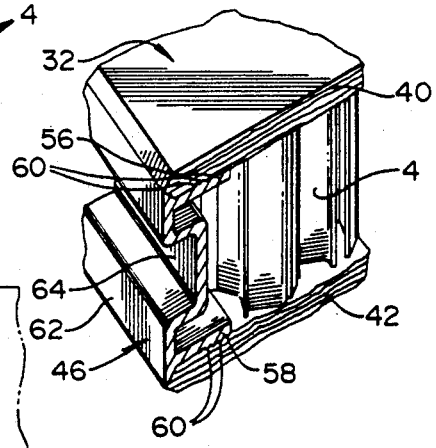
FIG. 3 is an enlarged, fragmentary view of the platform segment depicted in FIG. 2 showing the internal structure of the platform segment.

Referring in particular to FIGS. 2 and 3, each platform segment 32 includes a top panel 40, a bottom panel 42, honeycomb support structure 44 extending between the top and bottom panels 40, 42, and extruded peripheral edging 46. Each platform segment forms an isosceles triangle with a base edge 48, and opposed side edges 50, 52. Referring to FIG. 2, the side edges 50, 52 terminate in a radiused apex 54 adapted for coupling with the connecting hub 34.

The top and bottom panels 40, 42 may be formed from a variety of materials such as pressboard, plywood, or any other durable, lightweight material. The honeycomb support structure can be formed from a variety of synthetic resin materials, or paper or similar fiber material.

Figure 4:
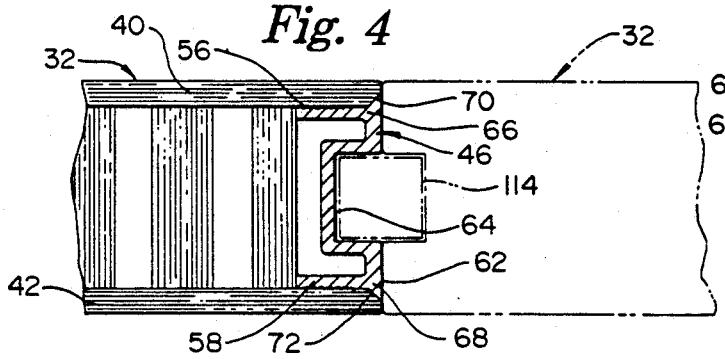
FIG. 4 is a sectional view taken along the line 4-4 of FIG. 3, with an adjoining platform segment depicted in phantom lines.

Peripheral edging 46 preferably comprises an extruded aluminum member, although the edging material can be made from any suitable, durable material. The edging 46 includes upper and lower panel engaging members 56, 58, each having panel engaging ribs 60. The peripheral edging 46 presents an external face 62 having an indented, belt receiving groove 64 extending along the length of the edging 46. Referring in particular to FIG. 4, the edging 46 also includes upper and lower panel engaging facets 66, 68. The facets 66, 68 include inclined surfaces 70, 72 for mating with a beveled portion of the peripheral edges of the top and bottom panels 40, 42.

Figure 5:
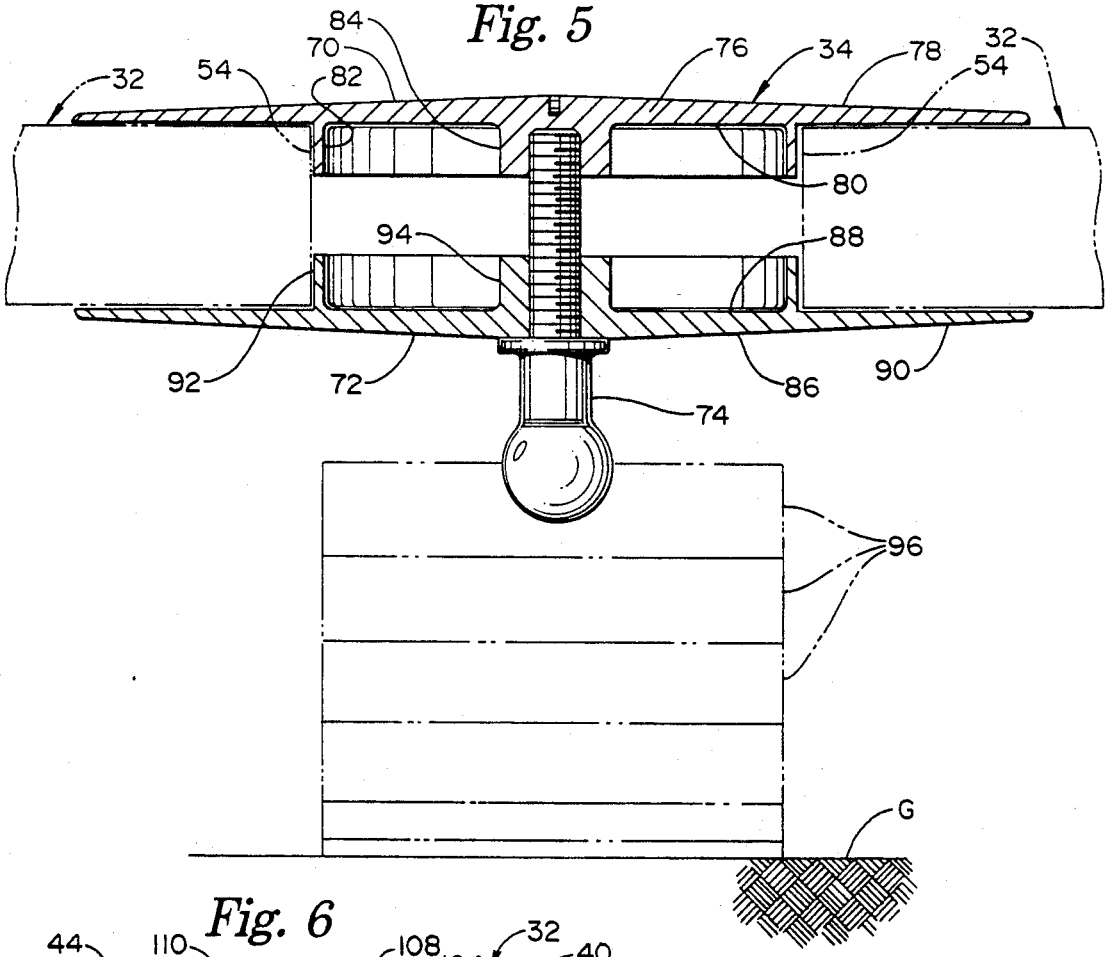
FIG. 5 is a fragmentary, sectional view of the connecting hub, with a pair of opposed platform segments and a hub support base depicted in phantom lines.

Referring to FIG. 5, connecting hub 34 includes top plate 70, bottom plate 72, and connecting bolt 74. Connecting bolt 74 is formed with a threaded shaft at one end and a spherical or ball-shaped head at its opposite or lower end, as shown in FIG. 5. The top plate 70 includes a generally circular cover 76 having top surface 78 and bottom surface 80. Bottom surface 80 includes a generally circular, segment apex engaging ring 82 and a centered, internally threaded, bolt receiving boss 84. Bottom plate 72 includes generally circular base 86 having top surface 88 and bottom surface 90. The top surface 88 of the base 86 includes generally circular, segment apex engaging ring 92, and centered bolt receiving boss 94. Connecting bolt 74 is received through bottom plate boss 94 and is threadably received within the top plate boss 84. As depicted in phantom lines in FIG. 5, the connecting bolt 74 is supported by a plurality of base shims 96 resting on the ground g.

Figure 6:
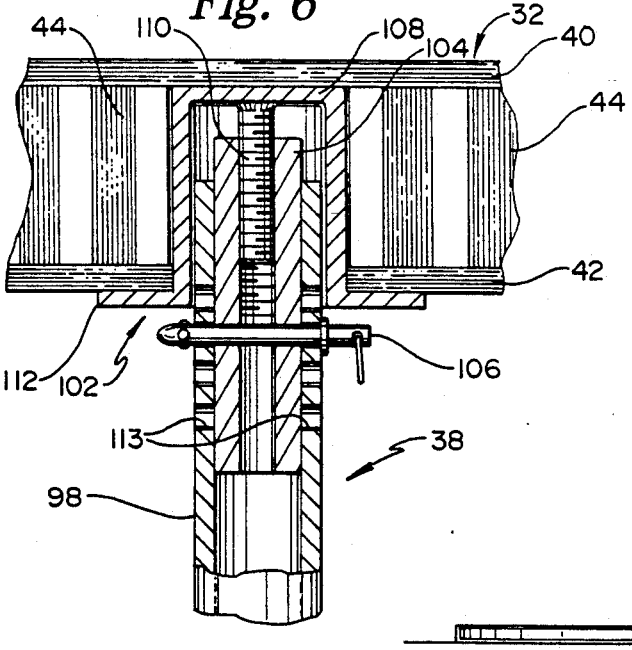
FIG. 6 is a fragmentary, sectional view of a platform segment and an adjusting leg therefor.
Figure 7:
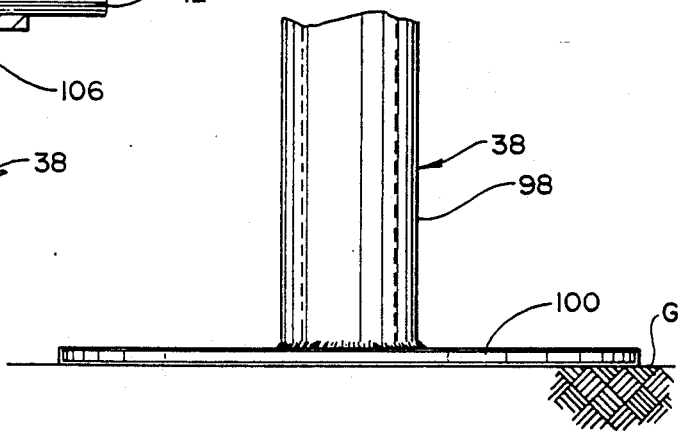
FIG. 7 depicts the foot of the adjustable leg depicted in FIG. 6.

One of the plurality of support legs 38 is depicted in detail in FIGS. 6 and 7. Each of the adjustable legs 38 includes a tubular sleeve 98 supported on a ground engaging foot 100, and an uppermost adjustment assembly 102. Referring to FIG. 6, the adjustment assembly 102 includes internally threaded, bolt receiving, generally tubular channel 104 received within the sleeve 98, removable retaining pin 106 supporting the channel 104 within the sleeve 98, and support cup 108. The support cup 108 includes centered, threaded member 110 threadably, adjustably received within the bolt receiving channel 104, and outwardly, radially extending panel support flange 112. The retaining pin 106 is receivable within one of a plurality of sets of pin receiving apertures 113 in sleeve 98.

Referring to FIG. 4, an elongated key 114 is receivable within the side edge grooves 64 of a pair of adjoining platform segments 32. Referring to FIG. 1, belt 36 is received within the groove 64 along the base edges of a plurality of assembled platform segments 32. The belt 36 includes a coupling latch 116.

Figure 8:
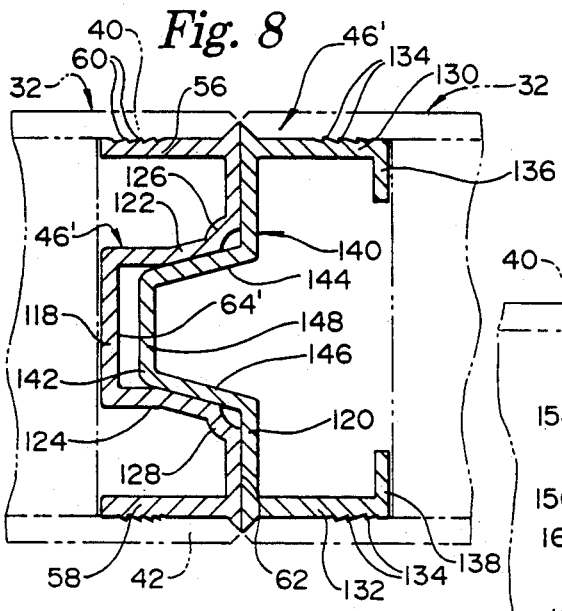
FIG. 8 depicts an alternate embodiment of the engageable edges of two platform segments.

Referring to FIG. 8, a first alternate embodiment of the peripheral edging 46' of a portable dance floor in accordance with the present invention is depicted. The edging 46' includes both a female edging member 118 and a male edging member 120. The female edging member 118 is similar in most respects to the edging member 46 describe above in conjunction with the first embodiment, and like elements are annotated with identical numbers. The groove 64' of the edging member 118, however, includes outwardly flared top and bottom groove walls 122, 124. The female edging member 118 also includes strength ribs 126, 128 extending along the junction of the top and bottom groove walls 122, 124 with the facing 62.

Male edging member 120 includes upper and lower panel engaging members 130, 132 that include panel engaging ribs 134. Upper and lower back plates 136, 138 are carried by the distal edges of the panel engaging members 130, 132. The front facing 140 of the male fitting member 120 includes outwardly extending rib 142 having sloped side walls 144, 146 and rib top wall 148. The rib 142, as can be seen from FIG. 8, is engageable within the groove of the female edging member 118. It will be appreciated that, in the second embodiment of the dance floor depicted in Fig. 8, the base edge 48 of the platform segments 42 will include a female edging member, and one of the side edges 50, 52 will have a female edging member 118 while the other side edge includes a male edging member 120.

Figure 9:
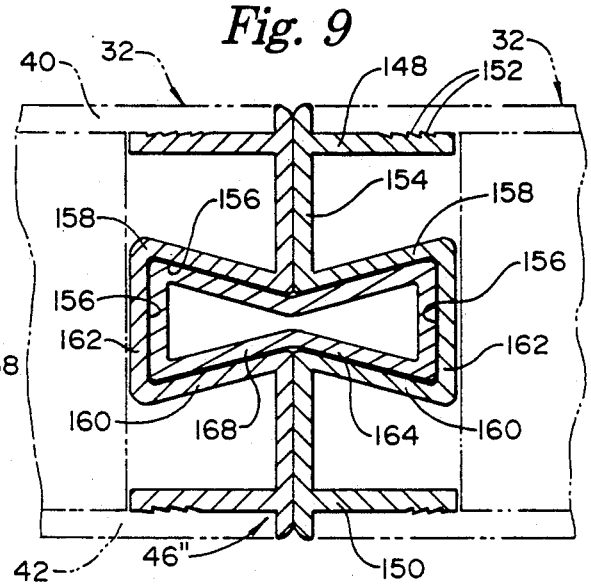
FIG. 9 is a second alternate embodiment of the platform edges of two platform segments.

Referring to FIG. 9, a third embodiment of the dance floor 30 in accordance with the present invention includes a further alternate arrangement of periphery edging 46''. The peripheral edging 46'' includes top and bottom panel engaging members 148, 150 having panel engaging ribs 152, and front facing 154 including a generally centered groove 156. The groove 156 includes opposed, upper and lower side walls 158, 160 that slope inwardly towards each other as they extend from the base wall 162 of the groove toward the front facing 154. An elongated key 164 having inwardly indented upper and lower surfaces 166, 168 is matingly received by the grooves 156 of adjoining edging members 46''.

Figure 10:
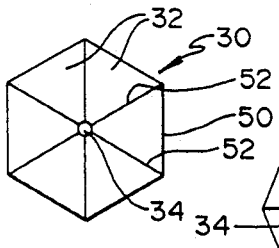
FIGS. 10-23 are top plan views of a variety of portable dance floor configurations made up of platform segments, all in accordance with the present invention.
Figure 11:
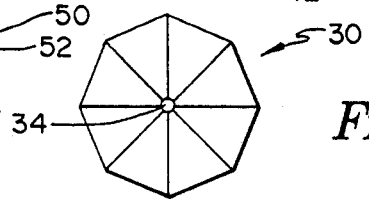
Figure 13:
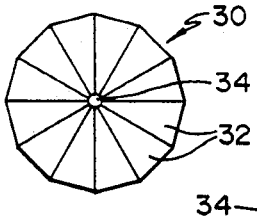
Figure 12:
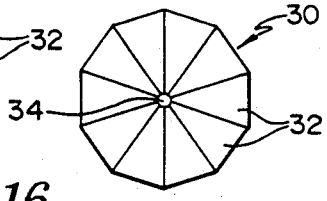
Figure 14:
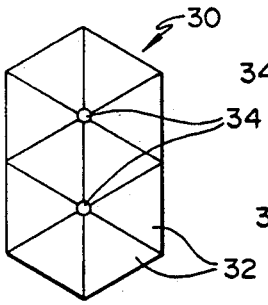
Figure 15:
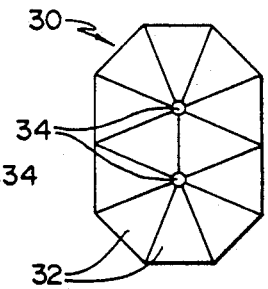
Figure 16:
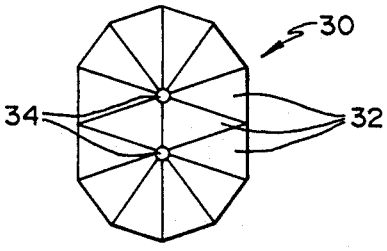
Figure 17:
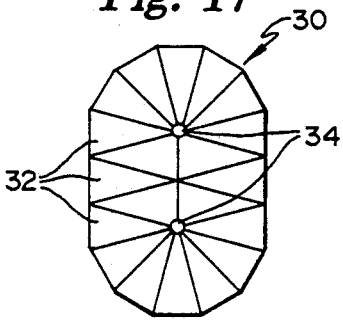
Figure 18:
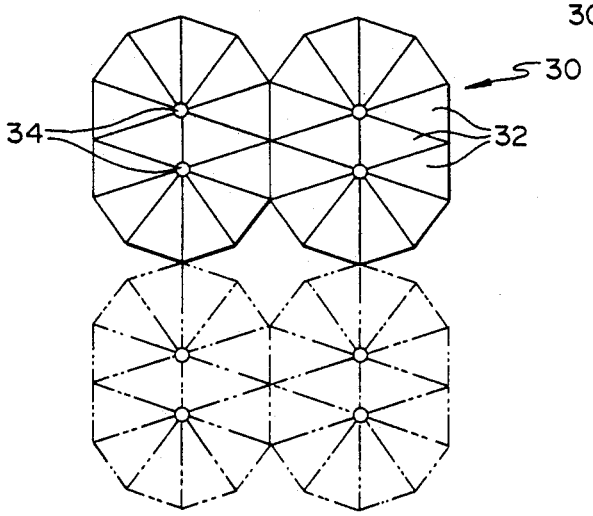
Figure 19:
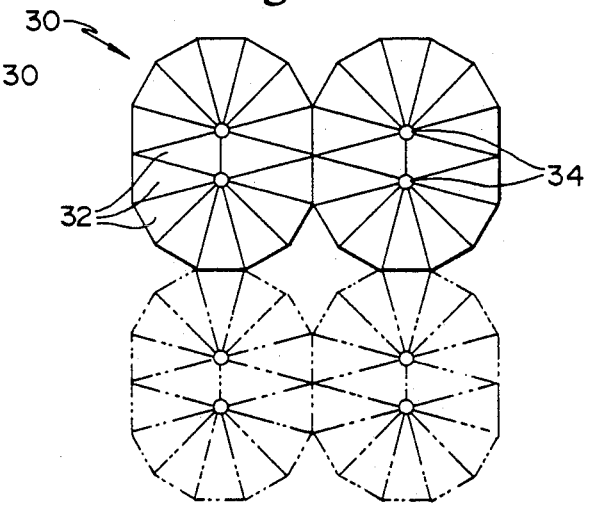
Figure 20:
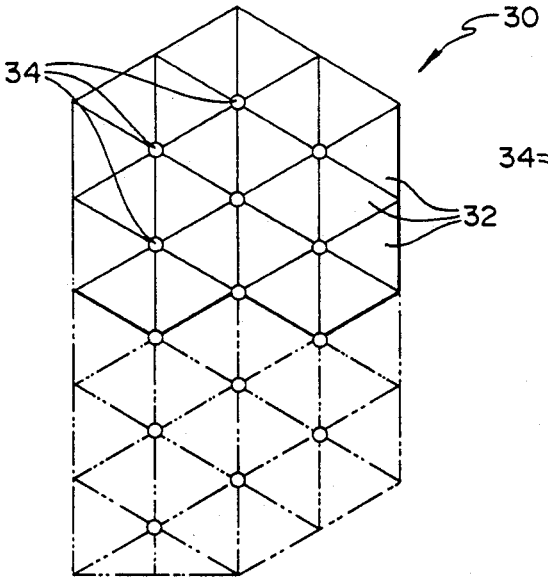
Figure 21:
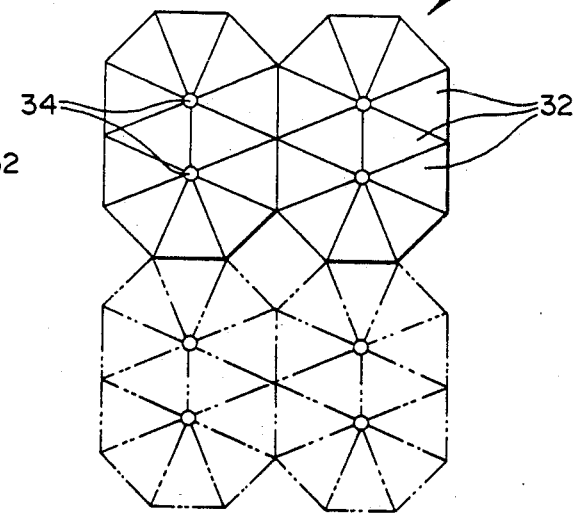
Figure 22:
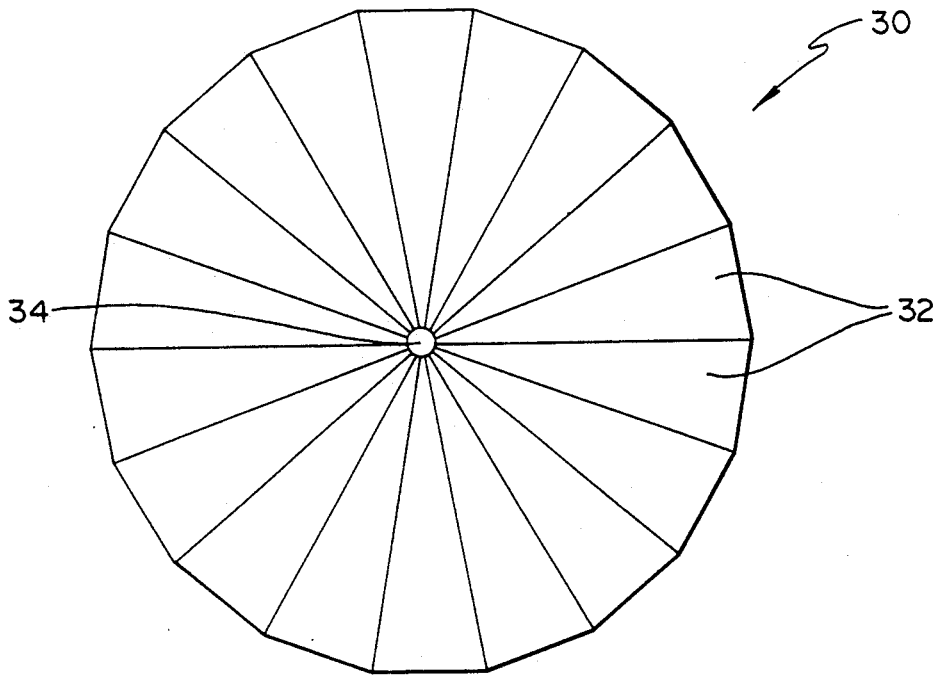
Figure 23:
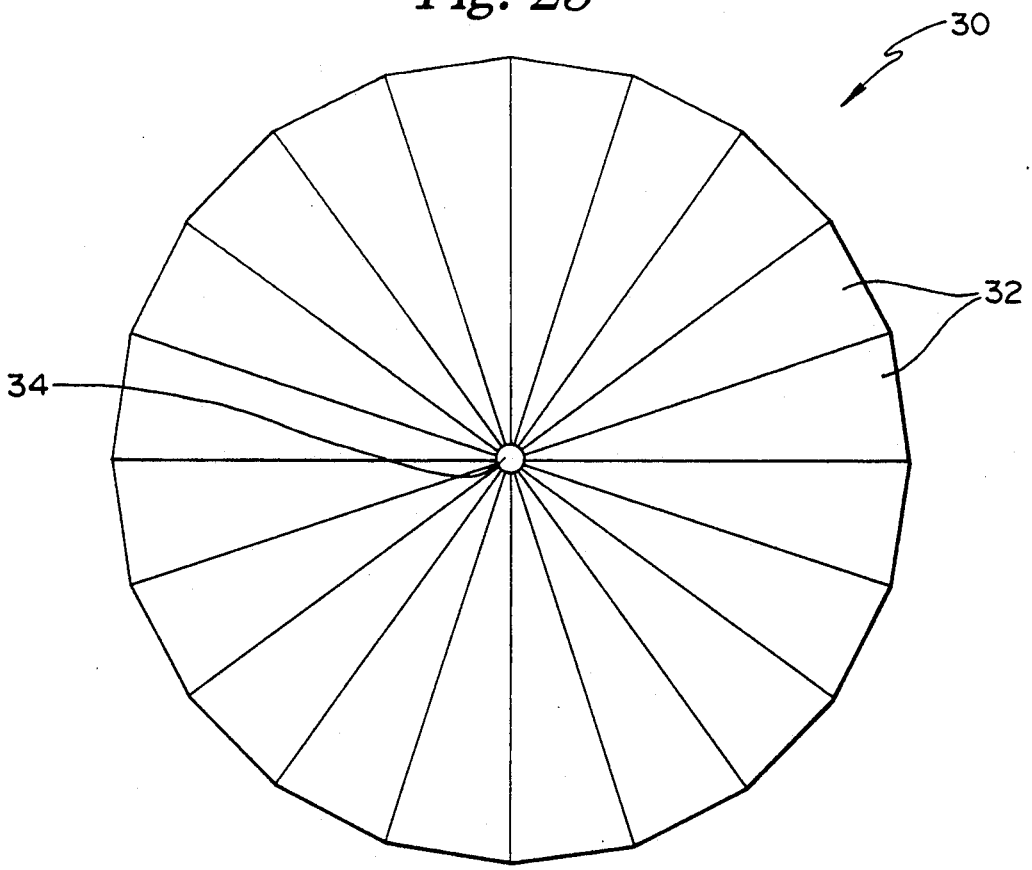

In operation, dance floor 30 in accordance with the present invention can be assembled from a plurality of platform segments 32 into a variety of configurations. Examples of such configurations are shown in FIG. 1 and FIGS. 10–23. In particular, FIG. 1, FIGS. 10–12, and FIGS. 22 and 23 depict dance floors 30 made from platform segments having base angles of different sizes. For instance, the base angles of the platform segments depicted in FIG. 10 are 60° (since there are 6 segments) and the base angles of the segments depicted in FIG. 13 are 30° (since there are 12 segments). Taking the example of FIG. 13, where the nominal base angle is 30°, it is preferable, in order to account for manufacturing tolerances, to have the base angles being just slightly less than 30°.

Referring to FIG. 1, assembly of a particular dance floor arrangement is accomplished by securing the adjoining apexes 54 of the platform segments 32 within connecting hub 34. The height of the connecting hub 34 above ground is adjusted by varying the number of shims 96 supporting the connecting hub bolt 74. The adjoining side edges of adjacent platform segments 32 receive the supporting key 114 or 168 in the first and third embodiments of the invention respectively, and are joined together by the tongue and groove arrangement provided by the male and female edging 118, 120 in the second embodiment of the invention. Belt 36 extends around the outer peripheral margin of the dance floor within the groove 64 of the base edge peripheral edging 46. The latch 116 is used to secure the belt 36 in a tight manner.

The platform surface is adjusted by adjusting the height of support legs 38. In particular, and referring to FIG. 6, the position of the bolt receiving channel 104 within leg sleeve 98 can be adjusted by removing retaining pin 106, shifting the channel 104 upwardly or downwardly, and reinserting the retaining pin 106 at a different height. Fine adjustments of the support leg height can be accomplished by rotating the support cup 108 to shift the threaded member 110 upwardly or downwardly within the bolt receiving channel 104.

I claim:

1. A portable dance floor elevated above a support surface comprising:

a plurality of load supporting platform segments, each segment comprising a generally triangular pie-shaped member having an upper plane surface, a base edge defining a groove extending the length thereof, opposed side edges, and an apex, said segments disposed with their upper plane surface in a common horizontal plane and their opposed side edges in abutting engagement;

means disposed in said opposed side edges extending continuously substantially the entire length of said opposed side edges for maintaining said upper plane surface of adjoining segments in said common horizontal plane;

a connecting hub assembly for coupling the apexes of a plurality of platform segments together and for maintaining said upper plane surface of adjoining segments in said common horizontal plane, said connecting hub assembly including a ball member mounted to and extending downwardly therefrom and a member engaging said ball member and extending to said support surface for supporting said connecting hub assembly and said apexes and upper plane surface in said common horizontal plane;

a belt member seated in said groove and extending around the peripheral margin defined by the base edge of the plurality of platform segments, and means for applying tension to said belt member to urge said segments and connector hub assembly into tight engagement; and adjustable leg members extending from said support surface to said segments in proximity to said base edge of said segments and supporting at least some of the platform segments.

2. The portable dance floor of claim 1 wherein said means extending substantially the entire length of said opposed side edges for maintaining said support surface of adjoining segments in said common horizontal plane comprises a tongue and groove joint.

* * * * *